US010377449B2

(12) United States Patent
Kalve

(10) Patent No.: US 10,377,449 B2
(45) Date of Patent: Aug. 13, 2019

(54) APPARATUS FOR HANDLING BOATS FROM A MIDSHIPS HANGAR OR MISSION BAY OF A MOTHER VESSEL

(71) Applicant: Vestdavit Gruppen AS, Laksevåg (NO)

(72) Inventor: Atle Kalve, Hordvik (NO)

(73) Assignee: Vestdavit Gruppen AS, Laksevåg (NO)

( * ) Notice: Subject to any disclaimer, the term of this patent is extended or adjusted under 35 U.S.C. 154(b) by 0 days.

(21) Appl. No.: 16/068,309

(22) PCT Filed: Jan. 9, 2017

(86) PCT No.: PCT/NO2017/050005
§ 371 (c)(1),
(2) Date: Jul. 5, 2018

(87) PCT Pub. No.: WO2017/119822
PCT Pub. Date: Jul. 13, 2017

(65) Prior Publication Data

US 2019/0016420 A1 Jan. 17, 2019

(30) Foreign Application Priority Data

Jan. 8, 2016 (NO) ..... 20160035

(51) Int. Cl.
*B63B 23/38* (2006.01)
*B63C 3/12* (2006.01)
*B63B 35/40* (2006.01)

(52) U.S. Cl.
CPC ..... *B63B 23/38* (2013.01); *B63C 3/12* (2013.01); *B63B 35/40* (2013.01); *B63B 2734/00* (2013.01)

(58) Field of Classification Search
CPC ..... B63B 23/38; B63C 3/12
See application file for complete search history.

(56) References Cited

U.S. PATENT DOCUMENTS

| | | | | |
|---|---|---|---|---|
| 1,118,499 | A | 11/1914 | Lake | |
| 2,319,855 | A | 5/1943 | Forsberg | |
| 9,963,206 | B2 * | 5/2018 | Kalve | B63B 27/36 |
| 2006/0182554 | A1 * | 8/2006 | Stolzer | B63C 3/12 414/281 |

FOREIGN PATENT DOCUMENTS

| | | | |
|---|---|---|---|
| GB | 191214420 | A | 6/1913 |
| GB | 580241 | A | 9/1946 |
| WO | WO-2012069853 | A2 | 5/2012 |
| WO | WO-2015069118 | A1 | 5/2015 |

OTHER PUBLICATIONS

Carlström, Göran, "International Search Report," prepared for PCT/NO2017/050005, dated May 2, 2017, five pages.

* cited by examiner

*Primary Examiner* — Stephen P Avila
(74) *Attorney, Agent, or Firm* — Winstead PC

(57) ABSTRACT

An apparatus for launching, stowing and retrieving of daughter boats (1) from a midships hangar or mission bay on a mother vessel comprises at least one davit assembly positioned atop a stationary cradle (2), located one each near the starboard and port of the mother vessel. The daughter boats (1) are secured on specially designed stationary cradle-salong a plurality of longitudinal tracks (5) and also on at least the two stationary cradles (2) one each near the starboard and port of the mother vessel which are also specially designed and lie along at least one transverse track (6).

10 Claims, 6 Drawing Sheets

APPARATUS FOR HANDLING BOATS FROM A MIDSHIPS HANGAR OR MISSION BAY OF A MOTHER VESSEL

FIELD OF THE INVENTION

The present invention in general, relates to an apparatus for handling boats from a midships hangar or mission bay of a mother vessel. The term boat is applied to cover rigid inflatable boats, unmanned surface vehicles, TEU containers and the like. This invention finds use in deploying and recovering boats for warships and also for seismic work as well as expedition cruise ships and yachts and the like.

Particularly, the present invention relates to handling of daughter boats on a mother vessel involving deploying and recovery of daughter boats in large numbers in a very short time by using an advantaguous apparatus and methodology according to present invention.

More particularly, the present invention relates to an apparatus for launching, stowing and retrieving daughter boats from a midships hangar or mission bay on a mother vessel according to the preamble of claim 1 and to a method therefor.

TECHNICAL BACKGROUND OF THE INVENTION

Apparatuses/devices for launching and recovery of daughter boats from and onto a mother vessel/ship are already known. Such daughter boats may be rigid inflatable boats, unmanned surface vehicles and the like. These are stowed in midships hangar or mission bay of a mother vessel.

These operations are common in respect of deploying and recovering boats say for warships and also for seismic work as well as expedition cruise ships and yachts and the like.

For launching daughter boats from a mother vessel, davits are connected to a line at each end of the boat and the boat is hoisted into water. This is time consuming and leaves the chances of detachment of the boats. Similar chances exist during recovery of the mother boat as well. Hence, this traditional method and similar such methods have potentialities of causing loss of life and material.

Deployment of ramp to avoid the problem in the aforesaid paragraph is known but then chances of collision exist in such ramp technology, which is none the less dangerous.

Slightly more advanced technology for launching and recovery of daughter boats are also known. Davit assemblies on each side of the mother vessel are known which are placed above a stationary cradle. Several transversely movable cradles carry these boats below the davit assemblies on the stationary cradle along rails for launching. However, the existence of too many transversely movable cradles limit the total space available for handling the daughter boats on the deck of the mother vessel. Further, too many davit assemblies have to be deployed for picking up the boats from the transversely moving cradles and for launching and retrieving the boats.

WO 20122069853, discloses a cradle for launching and recovering a boat. The cradle is shaped to have an axis and to support a boat. A moving mechanism moves the cradle in a first stowed position and to a second ramp position.

The prior art document acknowledged in the preceding paragraph and similar such documents not only have a complicated construction, but also fail to teach a simple mechanism by means of which a large number of daughter boats can be handled on and from the mother vessel in a very short time , using a simple technique.

GB 191214420 A describes an apparatus for deployment, retrieval and storage of daughter boats on a mother ship comprising at least two davit assemblies positioned above fixed cradles, each on starboard and port of the mother ship. A wagon transports the daughter boats transversely.

U.S. Pat. No. 1,118,499 A describes a device for deployment and storing daughter boats on a mother ship where the daughter boats are secured along a plurality of longitudinal rails. The daughter boats are moved along the longitudinal rails by longitudinal moving wagons and are transferred to a cradle on transverse rails where they are moved to deployment mechanisms on port or starboard side.

U.S. Pat. No. 2,319,855 describes a device for deployment and storing daughter boats on a mother ship, where the daughter boats are secured to movable cradles.

Published patent application WO2015/069118 of the same applicants does teach how to expeditiously launch and retrieve a large number of boats. The apparatus according to this document comprises a davit assembly positioned above a stationary cradle, each of which is located near a side edge of a deck of the vessel. The apparatus has a plurality of longitudinally movable cradles on the deck of the vessel, for securedly holding a plurality of boats thereon and the longitudinally movable cradles can move back and forth longitudinally and lift up vertically to transfer a boat onto or receive a boat from a transversely movable cradle. The transversely movable cradle can transversely move back and forth for placing a boat onto or for receiving a boat from any one stationary cradle. One disadvantage with this solution is that only one boat can be stored on each longitudinally movable cradle on each longitudinally tracks.

The present invention solves the drawbacks of prior art as recited in the preceding paragraphs by applying an apparatus which has specially designed cradles along a plurality of longitudinal tracks and at least one transverse track. One wagon move along each longitudinal track and two wagons move along the transverse track to pick up boats and deliver on stationary cradles one each at the starboard and port of the vessel.

The davit assembly atop such cradles launch the boats from such cradles or retrieve boats on such cradles for picking up by the transverse wagons and then by the longitudinal wagons for stowing in appropriate longitudinal tracks.

The boats are stowed in longitudinal tracks on stationary cradles. The stationary cradles along both the tracks are so designed so that wagons can easily pick up of load on these and can even pass through these cradles when empty thereby reducing the application of davit assembly to a minimum and making the overall process very expeditious.

OBJECTS OF THE INVENTION

It is the principal object of the present invention to provide an apparatus for launching, stowing and retrieving of daughter boats from a midships hangar or mission bay on a mother vessel, in large number and that too, in a simple manner.

It is another object of the present invention to provide a method for launching, stowing and retrieving of daughter boats from a midships hangar or mission bay on a mother vessel in large numbers and that too very expeditiously.

It is a further object of the present invention to provide an apparatus for launching, stowing and retrieving of daughter boats from a midships hangar or mission bay on a mother vessel which has a simple construction and is cost effective and involves minimum use of davit assembly.

How the other objects and other associated objects are fulfilled, will be clear from the description hereinafter.

All through the specification including the claims, the words "vessel", "ship", "daughter boat" "life boat", "cradle", "davit/davit assembly", "deck", to be interpreted in the broadest sense of the respective terms and includes all similar items/devices/methods in the field known by other terms, as may be clear to persons skilled in the art. Furthermore, as clarified at the beginning of this specification, the term boat is applied to cover rigid inflatable boats, unmanned surface vehicles, TEU containers and the like.

Restriction/limitation, if any, referred to in the specification, is solely by way of example and understanding the present invention.

SUMMARY OF THE INVENTION

Accordingly, the present invention relates to an apparatus for launching, stowing and retrieving of daughter boats from a midships hangar or mission bay on a mother vessel. It comprises at least one davit assembly positioned atop a stationary cradle, located one each near the starboard and port of the mother vessel, a transverse track and at least one longitudinally track, one or more transversely moving wagons and one longitudinally moving wagon for each longitudinal track, said daughter boats are secured on stationary cradles along the longitudinal tracks, said cradles comprises an aft bench and a front bench, said front bench is demountable, and the aft bench is pivotable about a vertical Preferably, one wagon is located along the longitudinal tracks and at least two wagons are located along the transverse track, whereby the wagons can move along longitudinal tracks to pick up and deliver boats from and on fixed cradles along longitudinal tracks and to deliver on or pick up boats from the wagons along the transverse track, the latter wagons being adapted to move transversely to deliver on and pick up boats from the fixed cradles located along the transverse track.

The longitudinal moving wagons and the transversely moving wagons are equipped with hydraulically operated telescopic lifting arrangement that can lift and lower the boats to the desired level.

The front bench is preferably provided with a sling/strap for holding the boat which can be hooked on/off for receiving or launching a boat.

The front bench can allow an empty wagon adjusted to its lowermost position, to pass underneath it and in that the front bench is provided with two lashings which are located far towards its lateral ends for unhindered passage of a wagon through an empty stationary cradle.

Most preferably, the stationary cradles have an aft bench which is at a height lower than the maximum lifting level of the wagons and the aft bench is fixed for stationary cradles at the extreme aft positions of the mother boat. Specially, the aft bench for the other stationary cradles is foldable for unhindered passage of a wagon through an empty cradle.

The present invention also provides a method for launching, stowing and retrieving of daughter boats from a midships hangar or mission bay on a mother vessel.

BRIEF DESCRIPTION OF THE DRAWINGS

Having described the main features of the invention above, a more detailed and non-limiting description of an exemplary embodiment, with reference to the drawings is provided below.

DETAILED DESCRIPTION OF THE INVENTION

Figure 1:
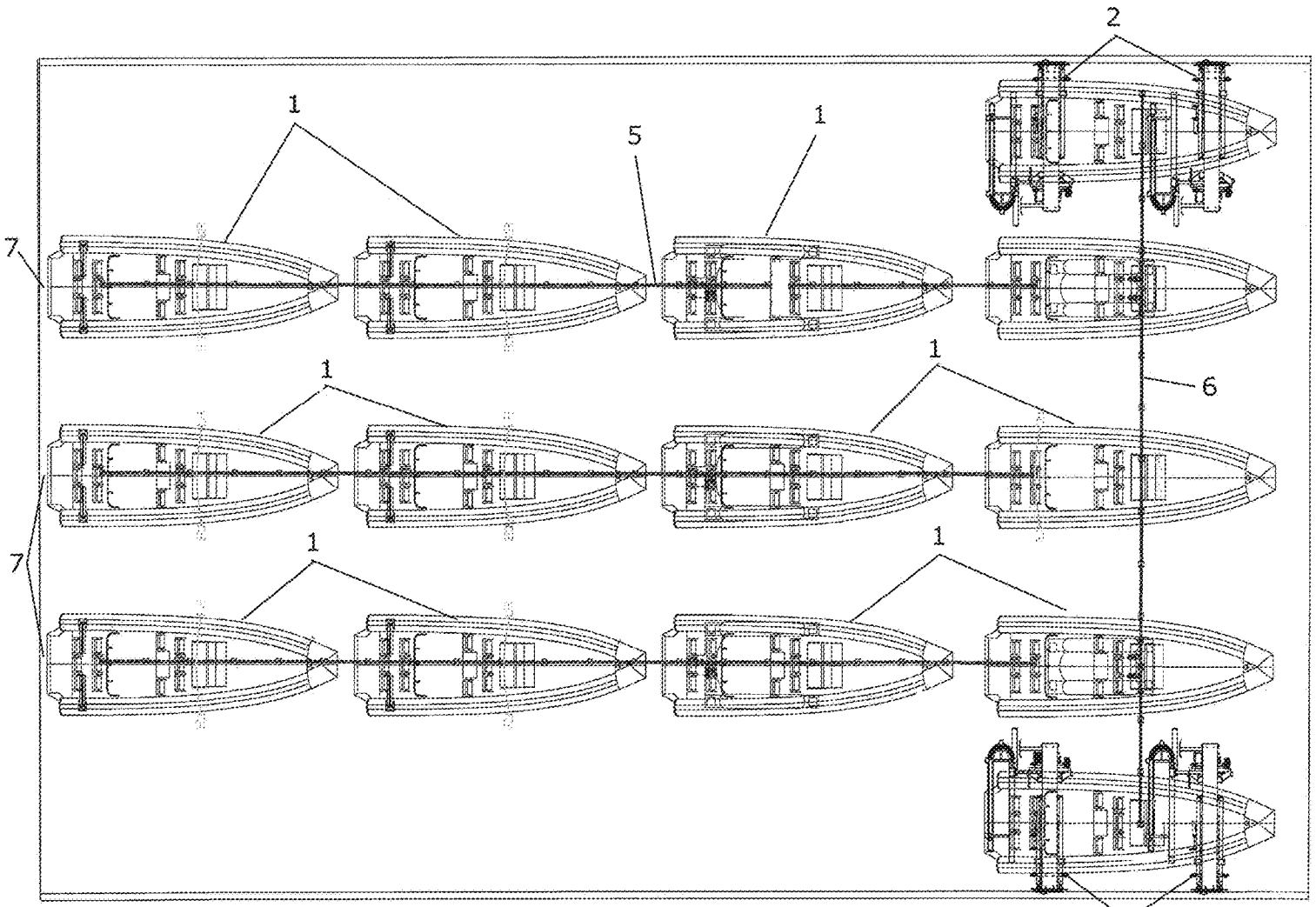
FIG. 1 is a view of the lay out of the apparatus of the present invention when the launching operation has not begun and the daughter boats are stowed.

The following describes a preferred embodiment of the present invention which is purely exemplary for the sake of understanding the invention and non-limiting.

In all the figures, like reference numerals represent like features. Further, when in the following it is referred to "top", "bottom", "upward", "downward", "above" or "below" , "right hand side " or "left hand side" and similar terms , this is strictly referring to an orientation with reference to the deck is considered to be horizontal with the sea bed, where the sea bed is considered to be horizontal and at the bottom.

It should also be understood that the orientation of the various components may be otherwise than shown in the drawings, without deviating from the principle of the invention. Furthermore, the vessel/ship in detail, davits/davit assemblies and other related units are not shown in detail, as those are not consequential to the present invention and should be understood by persons skilled in the art.

The number of components shown in the figures can also vary within the scope of the present invention. Furthermore, the description refers to lifeboats on a ship and similarly the figures also illustrate lifeboats. This is for the sake of simplicity. It should be understood that other daughter boats/vessels as may be known, also fall within the scope of the present invention.

FIG. 1 is a view of the lay out of the apparatus of the present invention when the launching operation has not begun and the daughter boats are stowed on the deck of the mother vessel. In fact the lay out is as seen from the top. It can be seen that the daughter boats 1 are stowed along longitudinal rows 5, which are three in the specific embodiment shown. Four mother boats 1 are stowed along each of the longitudinal tracks 5. Along the single transverse track 6, there are five daughter boats 1, three intersecting with the longitudinal tracks 5. The number of longitudinal tracks is flexible and can be from one to so many tracks that can be accommodated in the width of the ship. Further, the system is so flexible that all boats can be launched/retrieved using only the starboard or port davit assembly.

FIG. 1 further shows that two daughter boats 1 are mounted on two fixed cradles 2, one each at the starboard and at the port. Above these fixed cradles 2 lie the davit assembly (not shown) which launch or retrieve a boat on such fixed cradles 2. These fixed cradles have a special design, according to the present invention, as explained later. Fixed cradles are also provided along the longitudinal tracks 5, on which are mounted the daughter boats 1, but these are not shown in FIG. 1 for the sake of simplicity.

Figure 2:
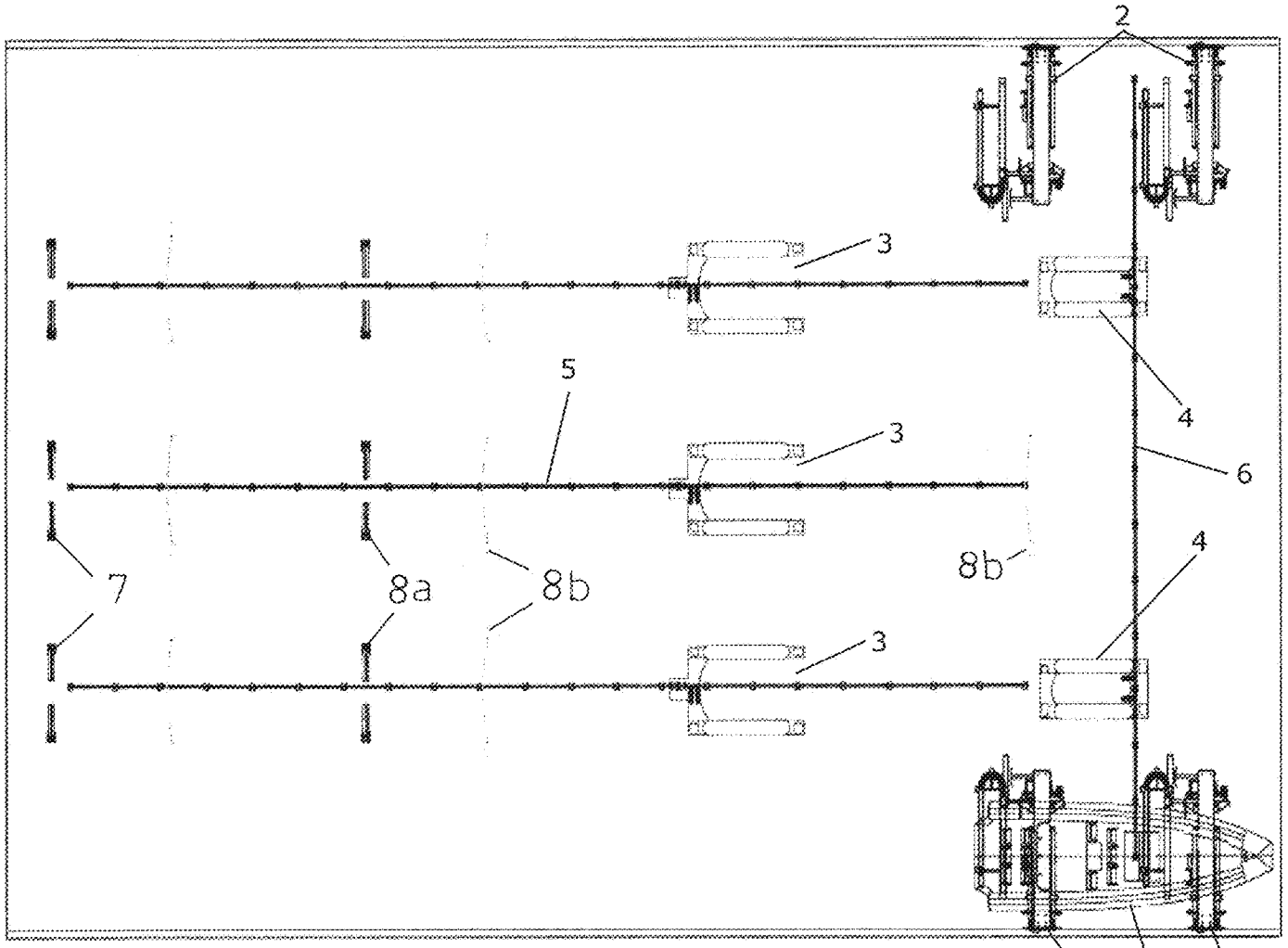
FIG. 2 is another view of the apparatus of the present invention, showing only the wagons and daughter boat on a specially designed cradle at the starboard of the mother vessel.

FIG. 2 is another view of the apparatus according to present invention, showing only the wagons 3, 4 and one daughter boat 1, on a fixed cradle 2 at the starboard of the mother vessel. It would be clear that along each longitudinal track 5 there is provided a single wagon 3 which can move along longitudinal rails 5. This wagon 3 has a lift and lower function as explained a later. These wagons 3 are meant to transfer or receive daughter boats 1 and for that purpose, they can move along longitudinal rails.

Figure 7A:
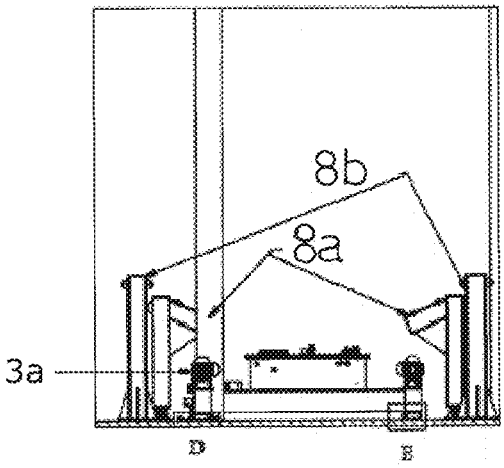
FIG. 7*a* is a view of a wagon and cradle which are deployed along the longitudinal paths.
Figure 7B:
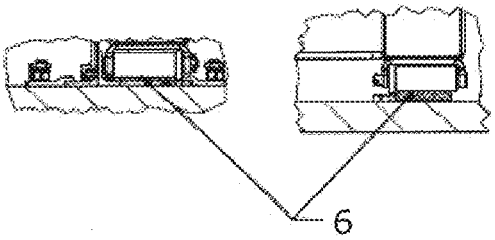
FIG. 7*b* is an enlarged view of wheels with guiding plates welded or bolted to deck.

FIG. 2 also shows wagons 4, meant to move along transverse rails 6 and they also have similar lift and lower function for transferring and receiving daughter boats 1. Preferably, the longitudinal moving wagons 3 and the transversely moving wagons 4 are equipped with hydraulically operated telescopic lifting arrangement 3*a*, 4*a* respectively (best shown in FIGS. 7*a* and 8) that can lift and lower the boats 1 to the desired level. For this purpose, the wagons can also be electrically driven.

FIG. 2 also depict fixed cradles along the longitudinal tracks 5. These cradles comprises an aft bench 7*a* and a front bench 7*b*. The front benches 7*a* can be demounted when placing or removing a daughter boat in order for the longitudinal moving wagon 3 to pass. For the same reason, the aft bench 7*b* is pivotable about a vertical axis.

Figure 3:
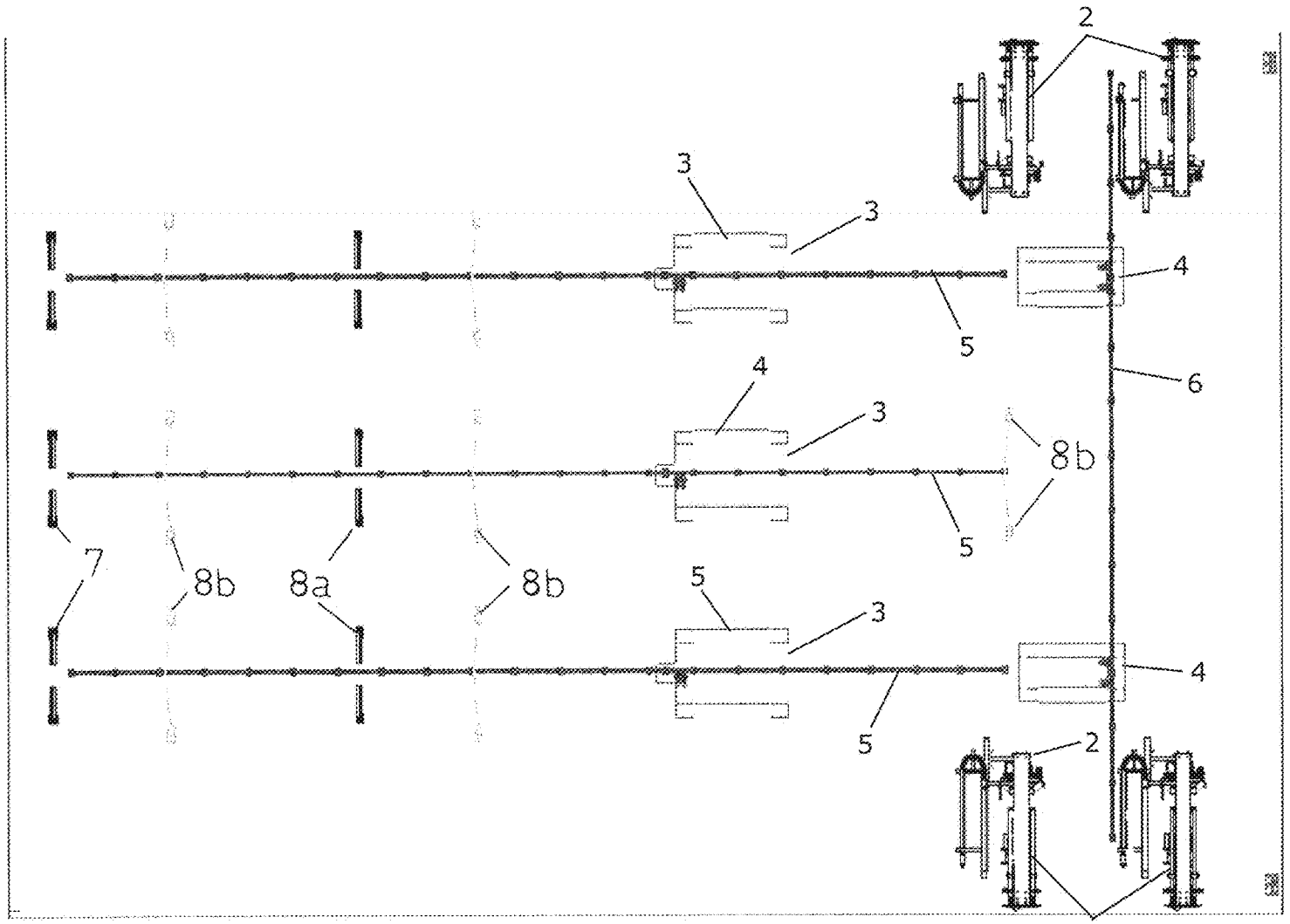
FIG. 3 is a view similar to that in FIG. 2, where the daughter boat has been launched from the specially designed cradle at the starboard.

FIG. 3 is a similar view as in FIG. 2, where the daughter boat 1 on the fixed cradle 2 at the starboard side has been launched.

Figure 4:
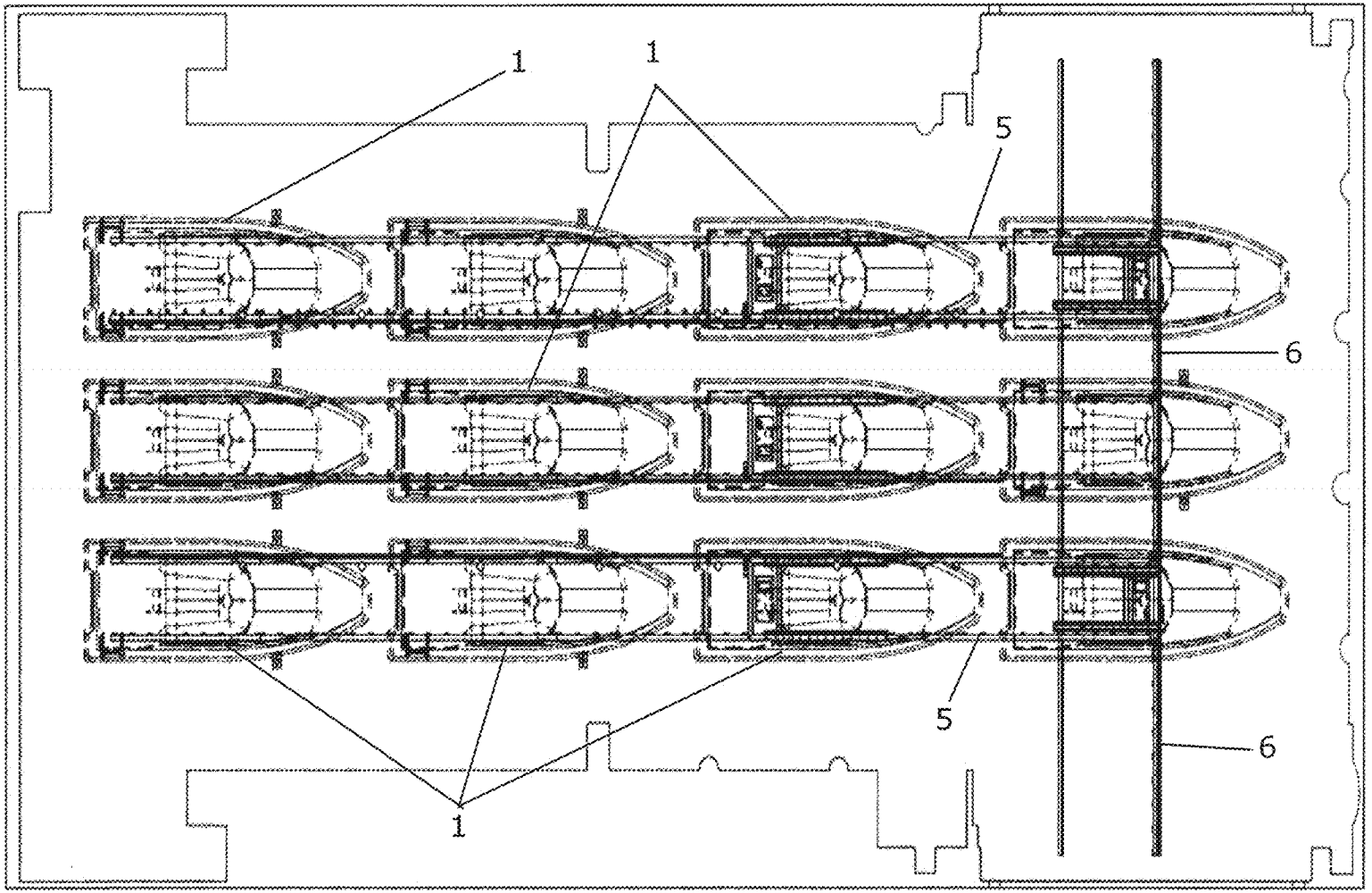
FIG. 4 is a view of the lay out of the apparatus similar to that in FIG. 1 but daughter boats have been launched from the starboard and port of the mother vessel.

FIG. 4 is a view of the lay out of the apparatus similar to that in FIG. 1 but daughter boats have been launched from the starboard and port of the mother vessel.

Figure 5A:
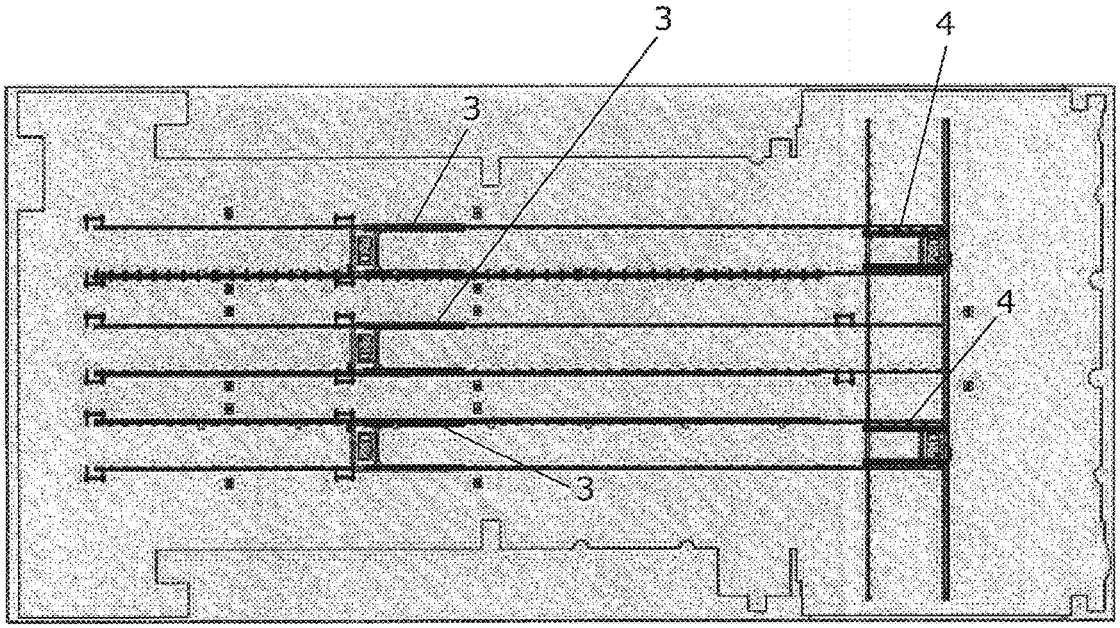
FIG. 5*a* is a view of the lay out of the apparatus, showing only the wagons and the longitudinal and transverse tracks.

FIG. 5*a* is a view of the lay out of the apparatus, showing only the wagons and the longitudinal and transverse tracks. From this figure, it would be clear, that there is one wagon 3 along each longitudinal track 5 and two wagons 4 along the transverse track 6. How these function would be clear from the detailed description of the functioning later.

Figure 5B:
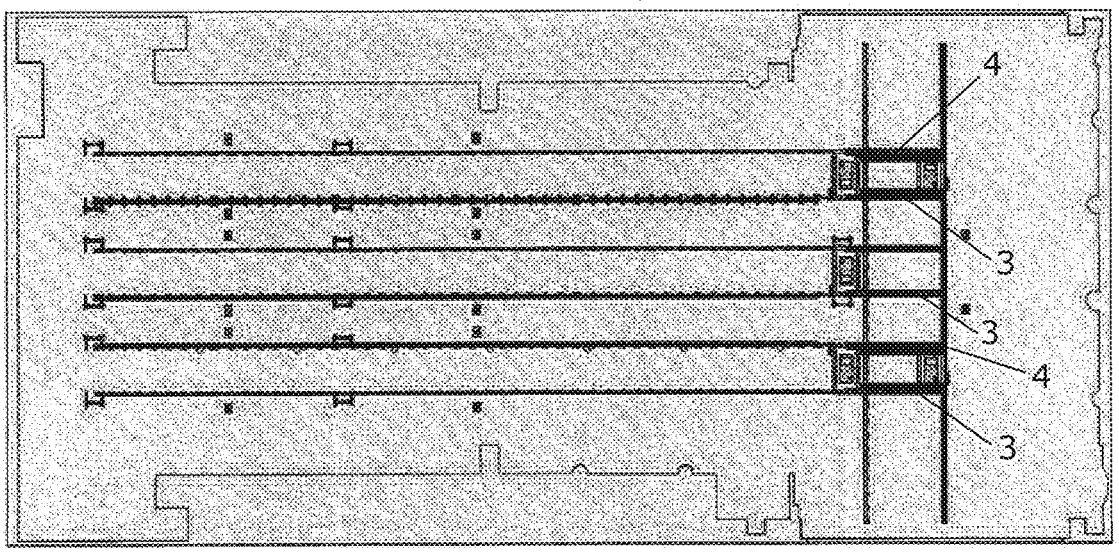
FIG. 5*b* is a view similar to that of FIG. 5*b*, but it shows a stage subsequent to that of FIG. 5*a*, where the wagons along the longitudinal tracks have moved.

FIG. 5*b* is a view similar to that of FIG. 5*b*, but it shows a stage subsequent to that of FIG. 5*a*, where the wagons along the longitudinal tracks 5 have moved and intersected with the two wagons 4 along the transverse track 6. It would be also clear that the wagons 3 movable along longitudinal tracks 5 are slightly bigger than the wagons 4 at the transverse track 6. In particular, it would be clear that two wagons 3 have engaged with two wagons 4 of the transverse track. The wagon 3 of the middle most of the two longitudinal tracks 5 has intersected with the transverse track 6, but it has to wait for a wagon 4 of the transverse track 6.

These aspects would be clear from the description of the functioning later.

The fixed cradles shown in FIG. 2, which lie along the longitudinal tracks 5, have a front bench 8*b* which can receive or transfer a boat 1 from or to a longitudinally moving wagon 3 and/or a transversely moving wagon 4 during launching or retrieving of a boat 1.

Preferably, the front bench 8*b* is provided with a sling/strap (not shown) for holding the boat 1 which can be hooked on/off for receiving or launching a boat 1.

The front bench 8*b* can allow an empty wagon 3, 4 adjusted to its lowermost position, to pass underneath it. The concerned wagon is lifted to receive or deliver a boat on a front bench 8*b* of a fixed cradle. The support in front must be unhooked for moving a boat forward. The front bench 8*b* can then be assembled again to receive a boat when it returns.

The stationary cradles have an aft bench 8*a* which is at a height lower than the maximum lifting level of the wagons 3, 4. The aft bench 8*a* is fixed for stationary cradles at the extreme aft positions 7 of the mother boat.

Figure 6:
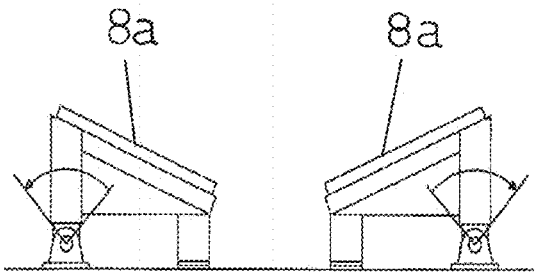
FIG. 6 is a view of an aft bench of specially designed cradle along longitudinal tracks on which daughter boats are secured.

As shown in FIG. 6 the aft bench 8*a* for the other stationary cradles is foldable for unhindered passage of a wagon through an empty cradle.

FIG. 8*a* is a view of a wagon and cradle which are deployed along the longitudinal paths. It can be seen that the front bench 8*b* is provided with two lashings which are located far towards its lateral ends for unhindered passage of a wagon 3 through an empty stationary cradle. It also shows the foldable aft benches 8*b* of the fixed cradles.

The FIG. 8*a* also shows the longitudinally moving wagons 3 with hoist/lower function 3*a*.

FIG. 8*b* is an enlarged view of wheels with guiding plates 6 welded or bolted to deck, which are meant for moving the wagons along the track rails 5, 6.

Figure 8:
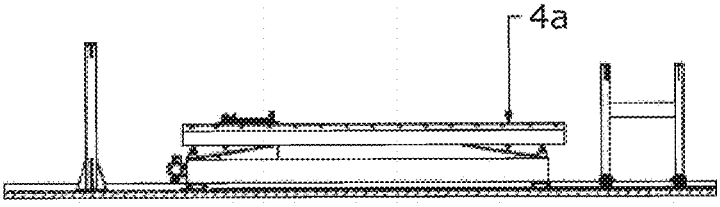
FIG. 8 is a view of a wagon and a cradle which are deployed along the transverse track.

FIG. 8 is a view of a wagon and a cradle, which are deployed along the transverse track. It shows the comparatively smaller wagons 4 with hoist/lower function 4*a*.

Having described elaborately the basic structure of the apparatus and the working interrelations of the various components now the functioning of the apparatus is described. For that purpose, all the above figures are again referred to, of course without detailing the structural aspects again.

In the embodiment shown, as stated hereinbefore, three longitudinal tracks 5 have been shown for the sake of easy understanding and only one transverse track 6 has been shown to interact with the longitudinal tracks 5. It should be understood that there can be plurality of longitudinal tracks and there can be another transverse track 6 at the other end of the mother boat/vessel and the launching/retrieval operation make take place from either end if so designed, and this is within the scope of the present invention.

Referring to FIG. 1, the deck of the mother boat is now perfectly arranged with daughter boats 1, for their launching. There are three longitudinal tracks 5 and one transverse track 6. First of all, the davit assemblies atop the fixed cradles 2 at the starboard and port pick up and launch two daughter boats 1.

Referring to FIG. 5*b*, two transversely moving wagons 4 of longitudinal rows near the starboard and port, have now met two longitudinally moving wagons 3, the latter carrying daughter boats atop it. These two daughter boats 3 are now transferred to the transverse wagons 4 and for that purpose, the transverse wagons 4 have to use their lifting device 4*a* in raised position. The transverse wagons 4 move transversely one towards the port another towards the starboard for delivering the daughter boat on the fixed cradles at the port and starboard by lifting its lifting device 4*a*, for launching of the boat 1 by the davit assembly.

Longitudinally moving wagons 3 of the two longitudinal tracks, near the starboard and port now go back to its lowest position and recede back to the respective tracks, to bring back the next daughter boat 1 from the respective longitudinal track 5, by lifting its lifting device 3*a*.

Now the front most daughter boat 1 at the middle one of the three longitudinal tracks 5 is taken away by any one transversely moving wagon 4 to the fixed cradle 2 at the starboard or port and launched by the davit assembly atop, in the same manner. Prior to this the transversely moving wagons 4 have to lower their lifting device 4*a* to their lower most position for moving away from the fixed cradles near the starboard and the port. The corresponding longitudinal wagon 4 now lowers its lifting device 3*a* to its lowermost position, recedes back to its longitudinal track 5 to bring the next daughter boat 1.

The two transverse wagons 4 now again line up with the longitudinal tracks 5 near the starboard and port. The longitudinal wagons 3 now lift up and carry a daughter boat 1 such that two intersect with the corresponding transverse wagons 4 and one just intersects with the transverse track, as shown in the transverse track 4 in FIG. 1. Thereafter the steps are repeated as in the portion starting with "Referring to FIG. 5*b* . . . "

The steps are repeated as many times as needed.

It would be also now clear with reference to the above functioning and also with reference to the description of structure of the apparatus, provided in the portion before the description of functioning the apparatus, that the lifting lowering function of the wagons 3, 4 and the construction of the front bench 8*b* and aft bench 8*a* of the fixed cradles, ensure that daughter boats 1 are perfectly transferred and received and no hindrance is caused to the movement of empty wagons through the cradles or movement of wagons with daughter boats loaded thereon, through empty cradles. This is essential because cradles are located all through the longitudinal tracks, for securely receiving daughter boats 1 thereon and wagons 3 have to move back and forth for collecting and delivering boats through cradles. This is equally true for cradles 2 at the starboard and port, along the transverse track 6. Further, the lifting and lowering of the wagons 3, 4 as well as the construction of the front bench 8*b* and aft bench 8*a* of the cradles enable delivering daughter boats 1 from the wagons to the cradles and vice versa. This is also true for delivering and receiving daughter boats 1 from longitudinally moving wagons 3 to transversely moving wagons 4 and vice versa.

The retrieval operation is just opposite to the launching opposition as explained with reference to the figures in the preceding description and it is not elaborated for the sake of brevity particularly as it would be clear to persons skilled in the art.

In short, the retrieval operation will be as follows:

(a) lifting the boats (1) from the sea by davits and transferring on a fixed cradle (2) at the starboard and port by the respective davit assembly atop the cradle;

(b) moving the transversely moving wagons (4) below the respective cradle (2) lifting their lifting device (4*a*) to receive boats thereon;

(c) moving the transversely movable wagons (4) along the transverse rail (6) and positioning those selectively in line with two longitudinal tracks (5) next to the starboard and the port;

(d) moving the two corresponding wagons (3) along the respective longitudinal tracks (5) with their lifting device (4*a*) lowered to intersect the corresponding transversely moving wagons (3);

(e) lifting the lifting device (3*a*) of the longitudinally moving wagons (3) of step (d) and receiving the boats (1) from the transversely moving wagons (4) of step (d);

(f) receding back of the two longitudinally moving wagons (3) to the corresponding longitudinal track and in that event the aft benches (8*a*) of empty cradles along the respective longitudinal track get folded for unhindered passage of the wagon (3) and on reaching just before the extreme aft end lowering of the lifting devices (3*a*) for placing the boat (1) on the fixed cradle at the extreme aft end;

(g) repeating steps (a) to (f) as many times as needed, each time a cradle in a longitudinal track is filled up starting from the extreme aft end (7) in that order, till the desired maximum stowing possible is achieved.

From the description with reference to the drawings, it would be clear to persons skilled in the art that all objectives of the invention have been achieved.

The present invention has been described with reference to some preferred embodiments and some drawings for the sake of understanding only and it should be clear to persons skilled in the art that the present invention includes all legitimate modifications within the ambit of what has been described hereinbefore and claimed in the appended claims.

The invention claimed is:

1. An apparatus for launching, stowing and retrieving of daughter boats from a midships hangar or mission bay on a mother vessel, the apparatus comprising:

at least one davit assembly positioned atop a stationary cradle, located one each near the starboard and port of the mother vessel, a transverse track and at least one longitudinally track, one or more transversely moving wagons and one longitudinally moving wagon for each longitudinal track; and, wherein the daughter boats are secured on stationary cradles along the longitudinal tracks, the cradles comprises an aft bench and a front bench, the front bench is demountable, and the aft bench is pivotable about a vertical axis.

2. The apparatus according to claim 1, wherein one wagon is located along the longitudinal tracks and at least two wagons are located along the transverse track, whereby the wagons can move along longitudinal tracks to pick up and deliver boats from and on the fixed cradles along longitudinal tracks and to deliver on or pick up boats from the wagons along the transverse track, the latter wagons being adapted to move transversely to deliver on and pick up boats from the fixed cradles located along the transverse track.

3. The apparatus according to claim 1, wherein the longitudinal moving wagons and the transversely moving wagons are equipped with hydraulically operated telescopic lifting arrangement that can lift and lower the boats to the desired level.

4. The apparatus according to claim 1, wherein the front bench is provided with a sling/strap for holding the boat which can be hooked on/off for receiving or launching a boat.

5. The apparatus according to claim 1, wherein the front bench can allow an empty wagon adjusted to its lowermost position, to pass underneath it and in that the front bench is provided with two lashings which are located far towards its lateral ends for unhindered passage of a wagon through an empty stationary cradle.

6. The apparatus according to claim 4, wherein the front bench can be reassembled back to a position to receive a boat during retrieval.

7. The apparatus according to claim 1, wherein the aft bench which is at a height lower than the maximum lifting level of the wagons.

8. The apparatus according to claim 7, wherein the aft bench is fixed for stationary cradles at the extreme aft positions of the mother boat and in that the aft bench for the other stationary cradles is foldable for unhindered passage of an wagon through an empty cradle.

9. A method for launching boats by applying the apparatus according to claim 1, the method comprising:

(a) moving the transversely movable wagons along the transverse rail and positioning those selectively in line with two longitudinal tracks next to the starboard and the port;

(b) applying the lifting device of longitudinally moving wagons to lift up a boat on a fixed cradle at the respective longitudinal track and moving the wagons to intersect the transverse track such that two of such wagons meet the corresponding two transversely moving wagons waiting on the transverse track at the starboard and the port;

(c) lowering the boats on the two transverse wagons, which lift up their lifting device for that purpose and transferring the two boats on the fixed cradles at the starboard and port by moving the wagons transversely to the starboard and port for launching of the boats by the respective davit assembly atop the fixed cradles;

(d) lowering of lifting device by the two empty longitudinally moving wagons and receding back to the corresponding longitudinal track for bringing the next boat, in the same manner as in (b);

(e) moving the two transversely moving wagons along the transverse rail to pick up the remaining boats on the longitudinally moving wagons which have intersected the transverse rail and launching the boats from the starboard and port one after another as in step (c);

(f) repeating step (d);

(g) repeating steps (a) to (f) as many times as required.

10. A method for retrieving boats from the sea by applying the apparatus according to claim 1, the method comprising:

(a) lifting the boats from the sea by davits and transferring on a fixed cradle at the starboard and port by the respective davit assembly atop the cradles;

(b) moving the transversely moving wagons below the respective cradle lifting their lifting device to receive boats thereon;

(c) moving the transversely movable wagons along the transverse rail and positioning those selectively in line with two longitudinal tracks next to the starboard and the port;

(d) moving the two corresponding wagons along the respective longitudinal tracks with their lifting device lowered to intersect the corresponding transversely moving wagons;

(e) lifting the lifting device of the longitudinally moving wagons of step (d) and receiving the boats from the transversely moving wagons of step (d);

(f) receding back of the two longitudinally moving wagons to the corresponding longitudinal track and in that event the aft benches of empty cradles along the respective longitudinal track get folded for unhindered passage of the wagon and on reaching just before the extreme aft end lowering of the lifting devices for placing the boat on the fixed cradle at the extreme aft end; and (g) repeating steps (a) to (f) as many times as needed, each time a cradle in a longitudinal track is filled up starting from the extreme aft end in that order, till the desired maximum stowing possible is achieved.

* * * * *